US007550664B2

(12) United States Patent
Kamshima et al.

(10) Patent No.: US 7,550,664 B2
(45) Date of Patent: Jun. 23, 2009

(54) KEYBOARD APPARATUS

(75) Inventors: Yujiro Kamshima, Hamamatsu (JP); Shiro Uno, Hamamatsu (JP); Hitoshi Sato, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 448 days.

(21) Appl. No.: 11/395,424

(22) Filed: Mar. 31, 2006

(65) Prior Publication Data

US 2006/0219085 A1 Oct. 5, 2006

(30) Foreign Application Priority Data

Apr. 4, 2005 (JP) ..... 2005-107134

(51) Int. Cl.
*G10D 13/02* (2006.01)

(52) U.S. Cl. ..... 84/423 R

(58) Field of Classification Search ..... 84/423 R, 84/431–433, 438

See application file for complete search history.

(56) References Cited

U.S. PATENT DOCUMENTS 7,394,004 B2 * 7/2008 Muramatsu et al. ..... 84/174
2004/0074376 A1 * 4/2004 Varme ..... 84/483.2

FOREIGN PATENT DOCUMENTS

| | | |
|---|---|---|
| JP | 49-35210-01 | 6/1972 |
| JP | 51-36912 | 9/1976 |
| JP | 54-45529 | 9/1977 |
| JP | 64-23095 | 2/1989 |
| JP | 06-054090 | 7/1994 |
| JP | 06-054091 | 7/1994 |
| JP | 06-295172 | 10/1994 |

* cited by examiner

*Primary Examiner*—Kimberly R Lockett
(74) *Attorney, Agent, or Firm*—Foley & Lardner LLP

(57) ABSTRACT

A keyboard apparatus that can be manufactured with a simple process at a low cost while still providing the feeling and appearance of high quality. In one embodiment of the invention, side surfaces of the white keys in the keyboard apparatus comprises a grained portion with a wood grain pattern. In this embodiment, when a white key is pressed down, the grained portion is visible from the side to give the appearance that the white keys are made from wood with a layer of white resin on the top and front surface. In another embodiment of the invention, a lower surface of a front end portion of the white keys is packed with a material such as resin. With this embodiment, when a performer's fingernail hits the top surface of the white keys while using the keyboard apparatus, the production of an unpleasant sound can be avoided.

13 Claims, 10 Drawing Sheets

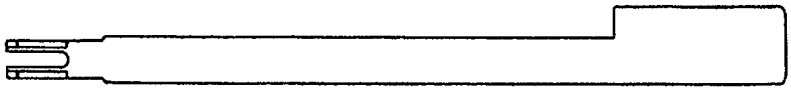
FIGURE 8(a)
FIGURE 8(a-1)
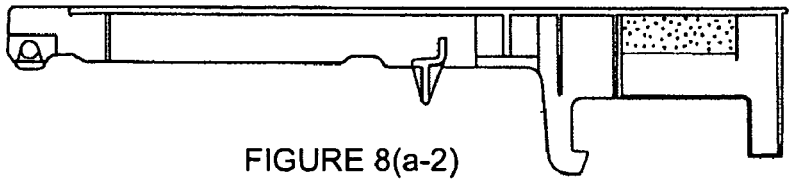
FIGURE 8(a-2)
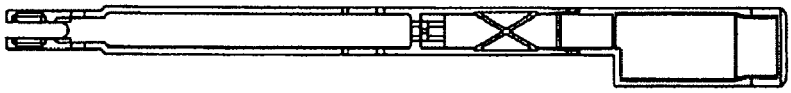
FIGURE 8(a-3)
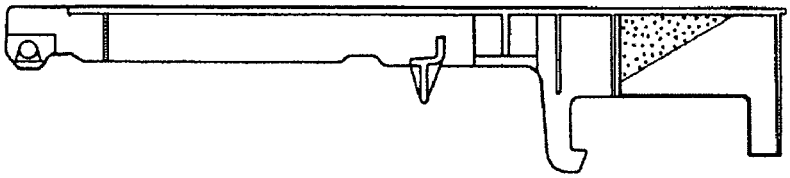
FIGURE 8(b)
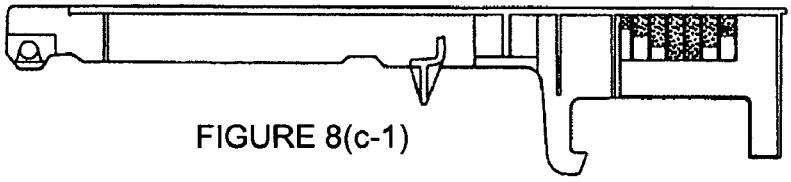
FIGURE 8(c)
FIGURE 8(c-1)
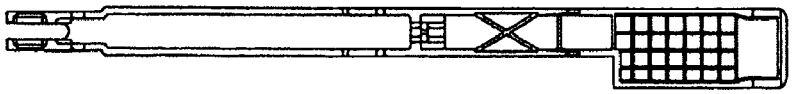
FIGURE 8(c-2)

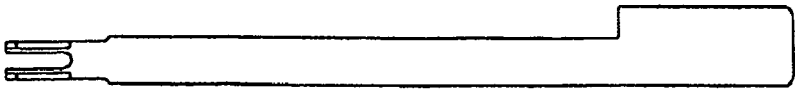
FIGURE 9(a-1)
FIGURE 9(a)
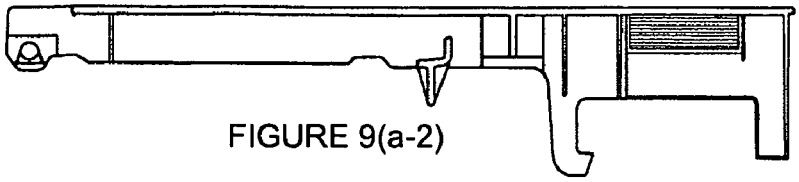
FIGURE 9(a-2)
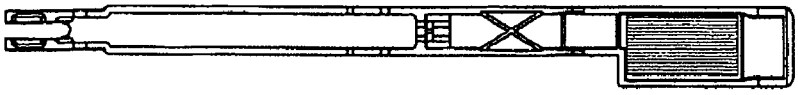
FIGURE 9(a-3)
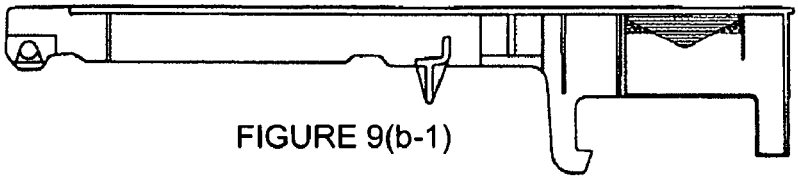
FIGURE 9(b-1)
FIGURE 9(b)
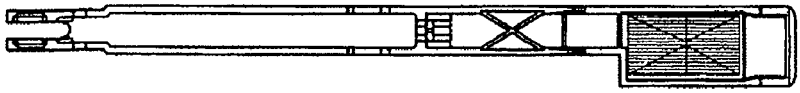
FIGURE 9(b-2)
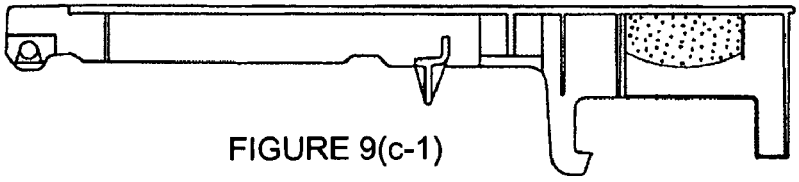
FIGURE 9(c-1)
FIGURE 9(c)
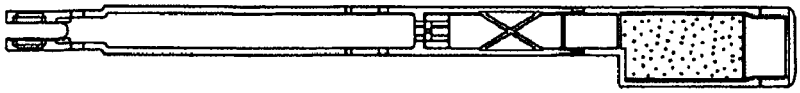
FIGURE 9(c-2)

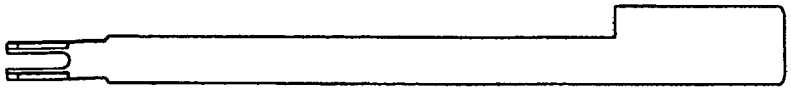
FIGURE 10(a-1)
FIGURE 10(a)
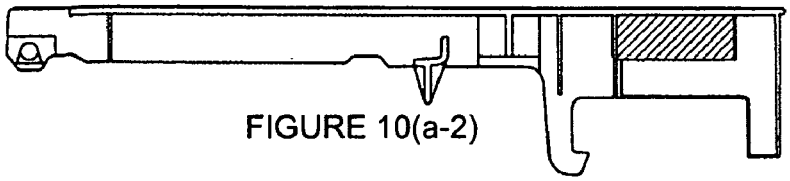
FIGURE 10(a-2)
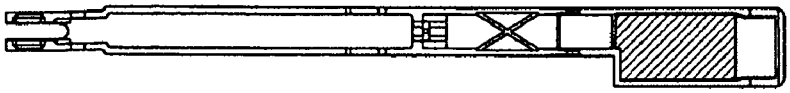
FIGURE 10(a-3)
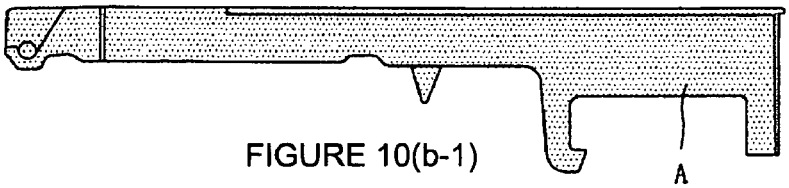
FIGURE 10(b-1)
FIGURE 10(b)
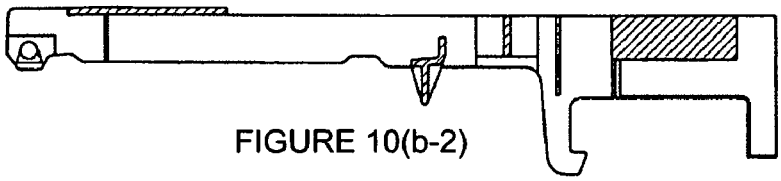
FIGURE 10(b-2)
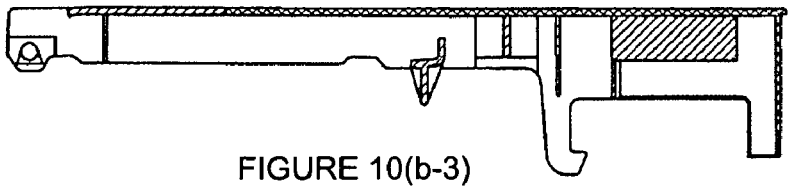
FIGURE 10(b-3)

KEYBOARD APPARATUS

CROSS-REFERENCE TO RELATED PATENT APPLICATIONS

This application claims priority to Japanese patent application No. 2005-107134 (filed on Apr. 4, 2005 in Japan), which was assigned to the applicants and is incorporated herein.

BACKGROUND OF THE INVENTION

The present invention relates to a keyboard apparatus that is used in a keyboard musical instrument.

For some time the keys that are used in musical instruments have been formed using materials such as resin. It is known that the side surface of the key can be colored such that when the key is pressed down, the movement of the key is easily recognized.

In Japanese Laid-Open Patent Application (Kokai) Publication Number Sho 49-35209, a keyboard apparatus is disclosed in which the entire side surface of the key has been colored with a color that is different from the base color.

With the keyboard apparatus disclosed in this previous patent reference, since the side surface of the key is colored differently from the base, it is simple to differentiate between the key that has been pressed down with keys that have not been pressed down. However, there is the problem that the appearance of the key is not very good and a feeling of high quality is lacking.

The present invention solves the problems described above and has as its object the provision of a keyboard apparatus that has a simple configuration, but the appearance is satisfactory in providing a feeling of high quality.

SUMMARY OF THE DISCLOSURE

In order to achieve this object, the keyboard apparatus in a first preferred embodiment comprises white keys that have a white colored resin on the side surfaces, a specific gap left between a top surface and a front surface, and a grained portion colored in a wood grain pattern having a specified area.

In a second preferred embodiment, the keyboard apparatus of the first embodiment has the additional feature that the grained portion is formed by printing the wood grain pattern on the white colored resin of the white keys.

In a third preferred embodiment, the keyboard apparatus of the first embodiment has the additional feature that the grained portion is formed from a wood grain pattern resin different from the white colored resin.

The keyboard apparatus in a fourth preferred embodiment comprises white keys using a double injection molding method. In this embodiment, the white keys comprises an outside portion forming a top surface and a side surface of the white keys comprising a white colored resin material, and an inside portion comprising a wood grain pattern resin material positioned below the outside portion that forms another side surface of the key.

In a fifth preferred embodiment, the keyboard apparatus of the fourth embodiment has the additional feature that the outside portion has the two surfaces, an upper surface and a side surface. The upper surface covers the top of the inside portion, the side surface joins to the upper surface on the left, right and front edge, and these two surfaces are formed from a plate having a roughly uniform thickness.

In a sixth preferred embodiment, the keyboard apparatus of any of the first to fifth embodiment can have the additional feature of having a lower surface of a front end portion of the white keys been packed with an adhesive agent that has a resin as a constituent.

In a seventh preferred embodiment, the keyboard apparatus of any of the first to fifth embodiment can have the additional feature of having a different resin to form a front end portion of the white keys using insert molding, from the resin used to form the white keys.

Since in accordance with the keyboard apparatus of the first embodiment, the keyboard apparatus comprises white keys that have a white colored resin on the side surfaces, a specific gap left between a top surface and a front surface, and a grained portion colored in a wood grain pattern having a specified area, there is the advantageous result that the keyboard apparatus has a simple configuration and the appearance satisfactorily provides a feeling of high quality.

In accordance with the keyboard apparatus of the second embodiment, in addition to the advantages of the first embodiment, since the grained portion is formed by printing the wood grain pattern on the white colored resin of the white keys, there is the advantageous result that it is possible to achieve a configuration that is simple and a structure that is low in cost.

In accordance with the keyboard apparatus of the third preferred embodiment, in addition to the advantages of the first embodiment, since the grained portion is formed from a wood grain pattern resin different from the white colored resin, there is the advantageous result that the structure is simple while still providing a feeling of high quality.

The keyboard apparatus of the fourth embodiment comprises white keys using a double injection molding method. In this embodiment, the white keys comprises an outside portion forming a top surface and a side surface of the white keys comprising a white colored resin material, and an inside portion comprising a wood grain pattern resin material positioned below the outside portion that forms another side surface of the key. Hence, there is the advantageous result that the appearance is satisfactorily provides a feeling of high quality with a simple configuration.

In the keyboard apparatus of the fifth embodiment, the outside portion has the two surfaces of an upper surface that covers the top of the inside portion and a side surface that is joined to the upper surface on the left, the right and the front, and these two surfaces are formed from a plate having a roughly uniform thickness. Hence, in addition to the advantages of the fourth embodiment, there is the advantageous result that even if the outside portion is formed using a high cost material, it is possible to keep the cost of the keyboard apparatus low by forming the inside portion with a low cost resin material, compared to the case in which the entire key is formed with a high cost material.

Since in accordance with the keyboard apparatus of the sixth embodiment, in addition to the of the previous embodiments, a lower surface of a front end portion of the white keys been packed with an adhesive agent that has a resin as a constituent, there is the advantageous result that even during a performance by a performer, when the surface of the white key is hit by a fingernail, an unpleasant sound is not produced.

Since in accordance with the keyboard apparatus seventh embodiment, in addition to the advantages of the previous embodiments, a resin different from the resin that forms the white keys is inserted in a front end portion of the white keys using insert molding, there is the advantageous result during a performance by a performer, when the surface of the white key is hit by a fingernail, an unpleasant sound is not produced. Furthermore, this can be manufactured with a simple manufacturing process.

BRIEF DESCRIPTION OF THE DRAWINGS

FIG. 1(*b*) is a cross-sectional drawing that shows the cross-sectional view of FIG. 1(*a*).

FIG. 2(*b*) is a planar drawing that shows the top surface of the white key; and, FIG. 2(*c*) is a lateral drawing that shows the left side surface of the white key.

FIG. 3(*b*) shows the shapes of the white keys corresponding to the C and E notes; FIG. 3(*c*) shows the shapes of the white keys corresponding to the F and B notes; FIG. 3(*d*) shows the shapes of the white keys corresponding to the G and A notes; FIG. 3(*e*) shows the shape of the white key corresponding to the D note; and, FIG. 3(*f*) shows the shape of the white keys corresponding to the A0 and C8 notes.

FIG. 5(*a*) shows a jib in which the left side of the key for note C8 and the right side of the key for note A0 can be printed at the same time. FIG. 5(*b*) shows a jig in which the left side of the key for note C and the right side of a key for note E, or the left side of a key for note F and the right side of a key for note B, can be printed at the same time. FIG. 5(*c*) shows a jig in which the left side of a key for note E and the right side of a key for note C, the left side of a key for note B and the right side of a key for note F, or the right and left sides of keys for notes G, A, and D, can be printed at the same time.

FIG. 6(*a*) shows the case in which a plate has been arranged; and, FIG. 6(*b*) shows the case in which a plate has not been arranged.

FIG. 7(*a*) is the lower portion of a white key; and, FIG. 7(*b*) is the upper portion of a white key.

FIG. 8 is a drawing that shows the aspect in which the front end portion of the white key has been packed with a material such as resin. FIG. 8(*a*) shows an embodiment where the material is packed parallel to the horizontal surface of the key. FIGS. 8(*a*-1), 8(*a*-2), and 8(*a*-3) shows the top, cross-sectional, and bottom views, respectively. FIG. 8(*b*) shows an embodiment where the material is packed sloped to the surface. FIG. 8(*c*) shows an embodiment where the material is packed in a lattice. FIGS. 8(*c*-1) and 8(*c*-2) show the cross-sectional and bottom views, respectively.

FIG. 9 is a drawing that shows the aspect in which the front end portion of the white key has been packed with other materials. FIGS. 9(*a*-1), 9(*a*-2), and 9(*a*-3) are the top, cross-sectional, and bottom views, respectively, of an embodiment where the material is packed parallel to the horizontal surface of the white key. FIGS. 9(*b*-1) and 9(*b*-2) are the cross-sectional and bottom views, respectively, of an embodiment where the packed material is in a peaked shape. FIGS. 9(*c*-1) and 9(*c*-2) are the cross-sectional and bottom views, respectively, of an embodiment where the surface of the packed material forms an arc.

FIG. 10(*a*) is a drawing that shows an item in which insert molding has been done in the front end portion of the white key with a resin that is different from the resin of the main body of the white key. FIGS. 10(*a*-1), 10(*a*-2), and 10(*a*-3) are the top, cross-sectional, and bottom views, respectively. FIG. 10(*b*) is a drawing that shows a white key in which the main body of the white key is molded with resins of two colors and, together with this, insert molding has been done in the front end portion of the white key with a resin that is different from the resin of the main body of the white key. FIG. 10(*b*-1) is a lateral surface drawing of the white key; FIG. 10(*b*-2) is a lateral cross-section drawing of the white key before the molding of a white colored resin; and, FIG. 10(*b*-3) is a lateral cross-section drawing that shows the white key after a white colored resin has been molded on the upper and front surface of FIG. 10(*b*-2).

DETAILED DESCRIPTION OF PREFERRED EMBODIMENTS

Figure 1A:
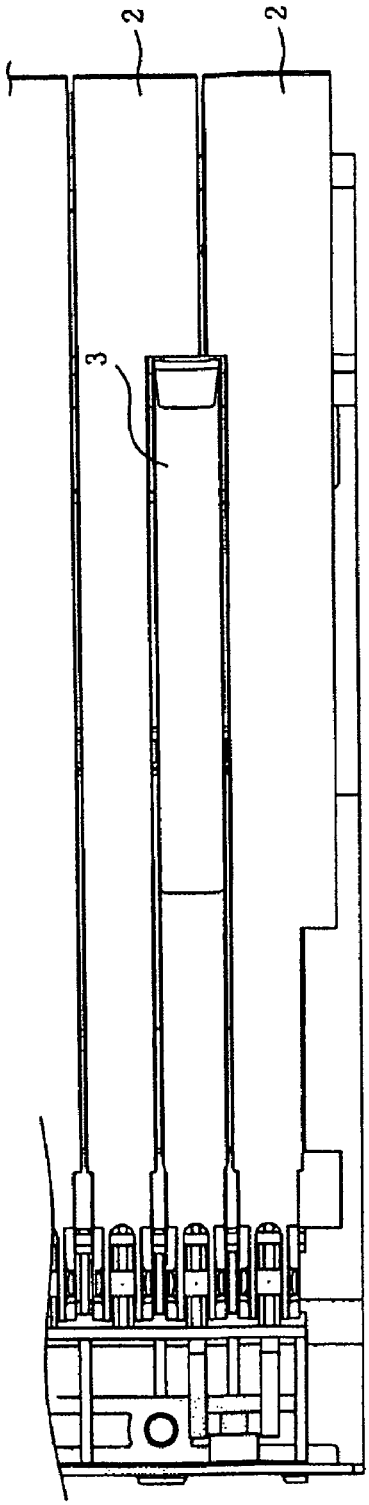
FIG. 1(*a*) is a planar view of the keyboard apparatus in accordance with one preferred embodiment of the present invention.
Figure 1B:
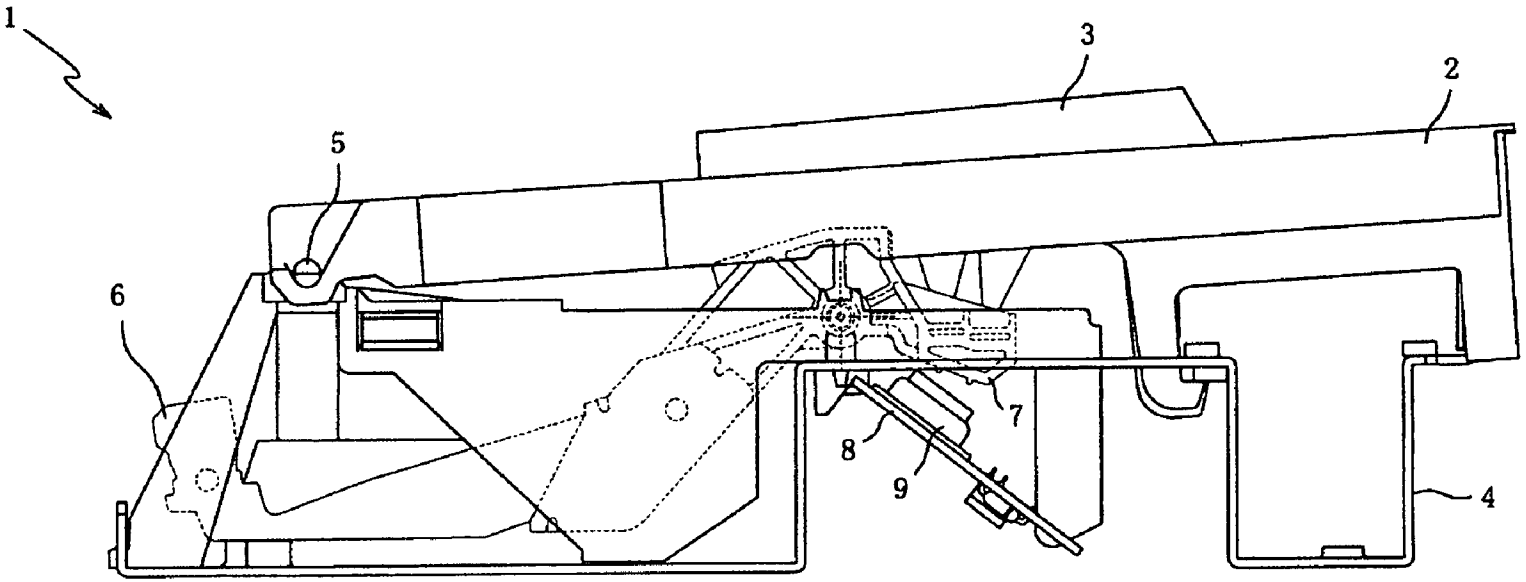

An explanation will be given below regarding one preferred embodiment of the present invention while referring to the attached figures. FIG. 1(*a*) is a planar drawing of the keyboard apparatus 1 and FIG. 1(*b*) is a lateral drawing of the keyboard apparatus 1.

The white keys 2 and the black keys 3 have swinging movement shaft holes in the rear end of the key. The keys swing centered around a shaft 5 disposed on the chassis 4. When a white key 2 or a black key 3 is pressed down, the hammer 6 is driven such that the hammer swings. The hammer 6 swings centered on a shaft disposed on the chassis 4 and an actuator 7 of the hammer 6 operates the switch 9 disposed on a printed circuit board fastened to the lower portion of the chassis 4. In the keyboard apparatus 1 the operation of the key is detected by the switch 9 in the manner described above.

Figure 2A:
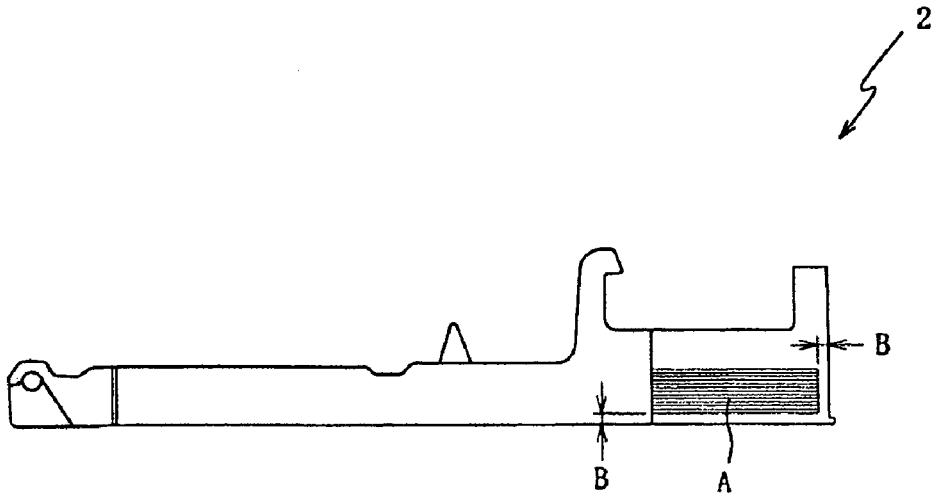
FIG. 2(*a*) is a lateral drawing that shows the right side surface of a white key.
Figure 2B:
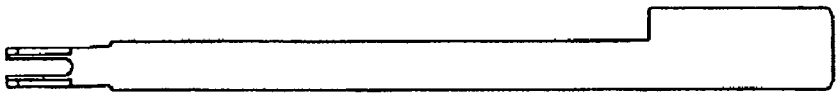
Figure 2C:
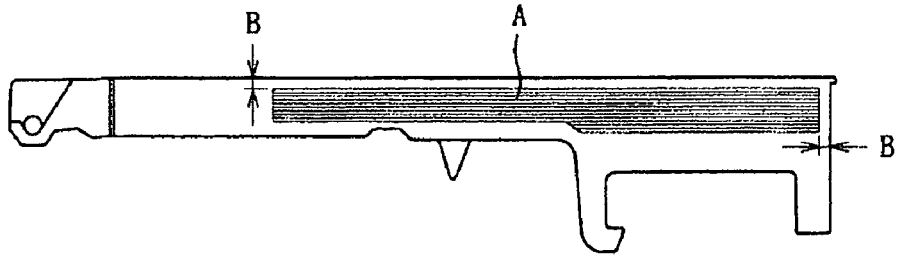
Figure 3F:
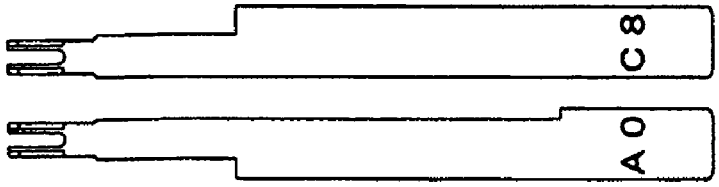
FIG. 3(*a*) is a planar drawing that shows the shapes of the various types of white keys.
Figure 3E:
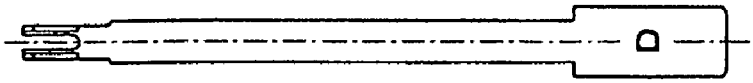
Figure 3D:
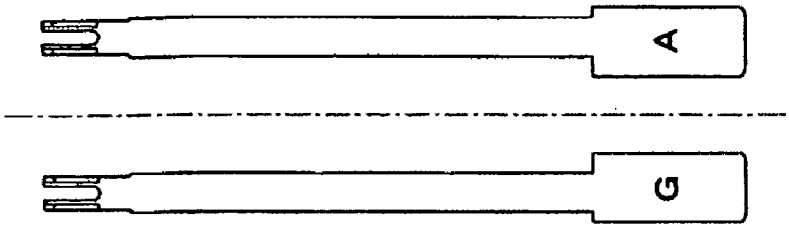
Figure 3C:
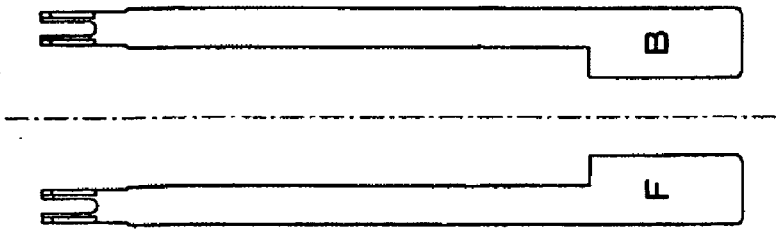
Figure 3B:
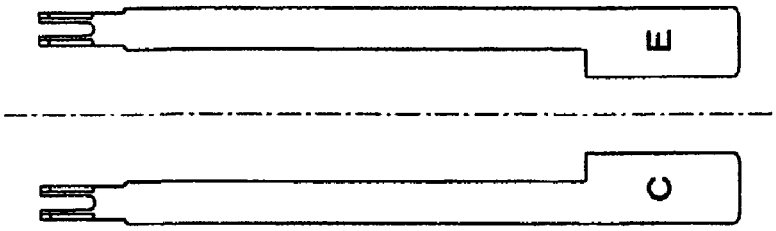
Figure 3A:
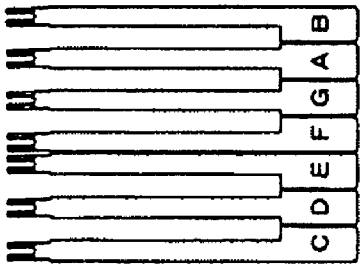

FIG. 2 shows the exterior of the white key 2. FIGS. 2(*a*), 2(*b*), and 2(*c*) are drawings that show the right side surface, the top flat surface, and the left side surface of the key, respectively. The white keys 2 have a shape that differs depending on the corresponding pitch of the keys. In this example, the left side surface formed a flat surface that extends across nearly the entire length and has a grained portion A from the front end of the flat surface to roughly ¾ of the overall length of the key.

On the other hand, because, as is shown in FIG. 2(*a*), a black key 3 is arranged between the right side surface and an adjacent white key 2, there is a step and the right side surface has a grained portion A only on the flat surface portion of the front end.

These grained portions A are formed separated by a gap B from the upper surface and the front surface of the key. Furthermore, the grained portion A is colored in a color tone having a wood grain pattern. By this means, when a key is pressed down, the side surface of the key is exposed and it give an appearance that the upper surface and front surface of the key are formed from a white colored resin on a main body formed from wood. Therefore, it is possible to produce a satisfactory appearance such that the keyboard apparatus provides a feeling of high quality with low cost materials.

The white keys 2 differ in their shapes depending on their position in conformance with the pitch notation (C, D, . . . ) at which they are arranged in the keyboard. FIG. 3 is a planar drawing that shows the different shapes of the white keys 2 in conformance with the pitch, as an example of this embodiment of the invention. FIG. 3(*a*) shows the relationship between the arrangement of the keys for one octave and the pitch notations. The black keys 3 are arranged between keys with pitch notations C and D, D and E, F and G, G and A, and A and B; while no black keys 3 are arranged between the pitch notations E and F, and B and C. As a result, as is shown in FIGS. 3(*b*), 3(*c*), and 3(*d*), the keys corresponding to pitch notations C and E, the pitch notations F and B, and the pitch notations G and A are bilaterally symmetrical. Also, as is shown in FIG. 3(*e*), the pitch notation D is bilaterally symmetrical with respect to the center line of the white keys 2. In addition, as is shown in FIG. 3(*f*), in the case of a keyboard that is configured with 88 keys, since there is no black key 3 arranged on the left side of the key of A0, the lowest pitch, and no black key arranged on the right side of the key of C8 , the highest pitch, the shape is different for those two keys from other keys having the same pitch notation.

Figure 4:
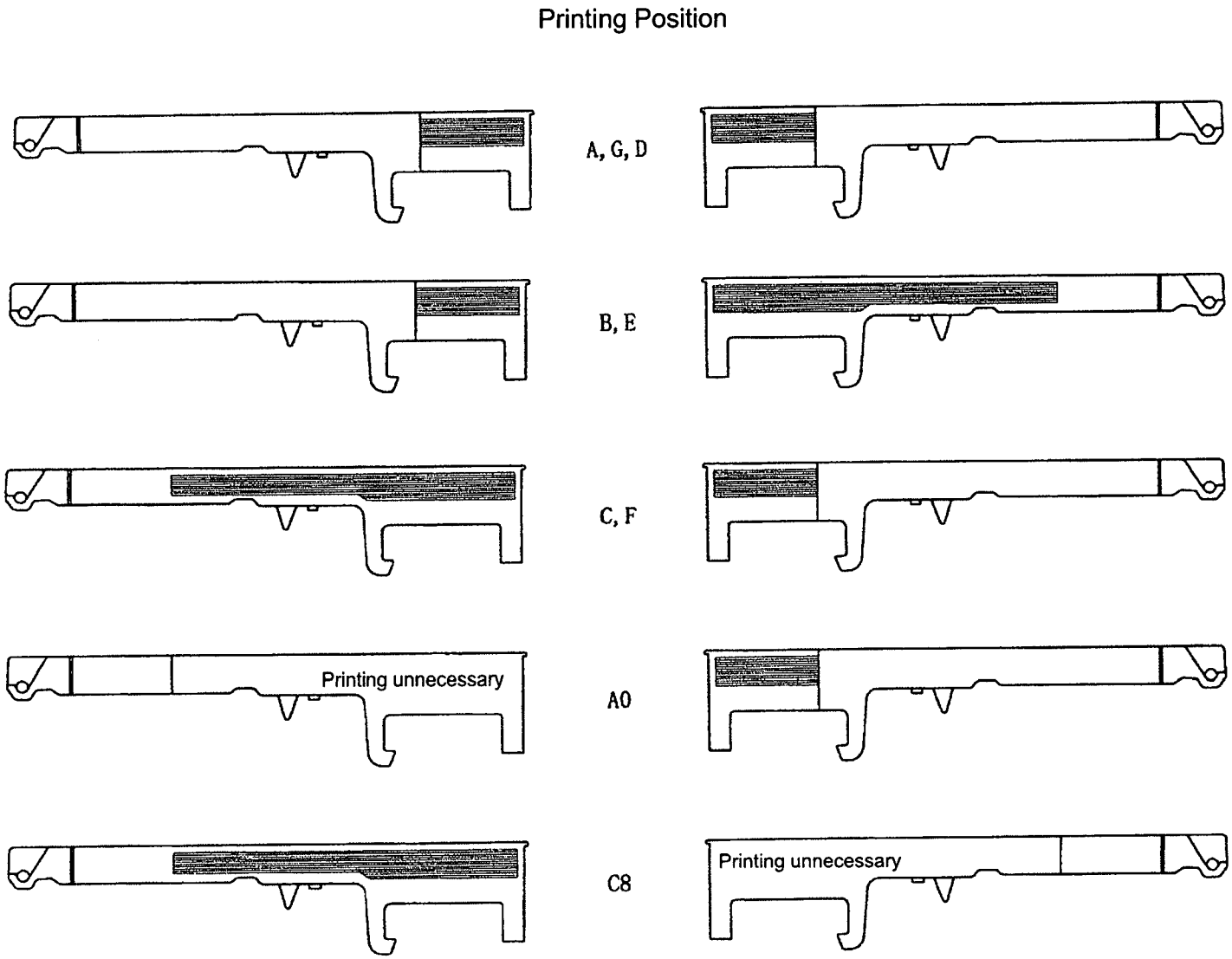
FIG. 4 is a lateral drawing that shows the printing position for different types of white key. The left column of FIG. 4 shows the printing position on the left side of the keys corresponding to the A, G, D notes; B and E notes, C and F notes, A0 note, and C8 note, respectively. The right column of FIG. 4 shows the printing position on the right side of the keys.

FIG. 4 is a lateral drawing that shows the differences in the positions at which the printing of the wood grain pattern is done depending on the types of these white keys 2. The left column of FIG. 4 shows the left side surfaces of the white keys 2 and the right column shows the right side surfaces of the white keys 2.

For the white keys 2 with pitch notations A, G, and D, on both the left and right side surface, the printing is done on the flat surface from the front end of the white key to the steps where black keys are arranged. For the white keys 2 with pitch notations B and E, on the left side, the printing is done on the flat surface from the front end of the key to the step where black keys 3 are arranged; on the right side, the printing is done from the front end of the white key up to roughly ¾ of the overall length of the key.

For the white keys 2 with pitch notations C and F, on the right side, the printing is done on the flat surface from the front end of the white key to the steps where black keys 3 are arranged; on the left side, the printing is done from the front end of the white key up to roughly ¾ of the overall length of the key. For the key of A0, lowest pitch of the keyboard, on the right side, the printing is done on the flat surface from the front end of the white key to the step where the black key is arranged, and; no printing is done on the left side. For the key of C8, the highest pitch of the keyboard, on left side, the printing is done from the front end of the white key up to roughly ¾ of the overall length of the key; and, no printing is done on the right side.

In those cases where the printing is done on these side surfaces, it is possible to perform the printing work efficiently if the white keys are assembled and set in a jig in conformance with the type.

Figure 5C:
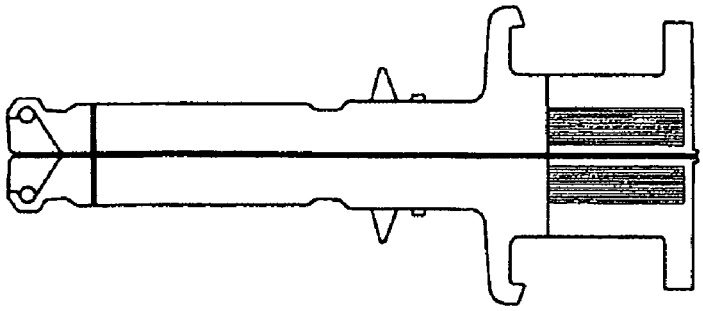
FIG. 5 is a planar drawing that shows a jig in which the white keys are assembled and arranged in order to efficiently carry out printing of the side surface.
Figure 5B:
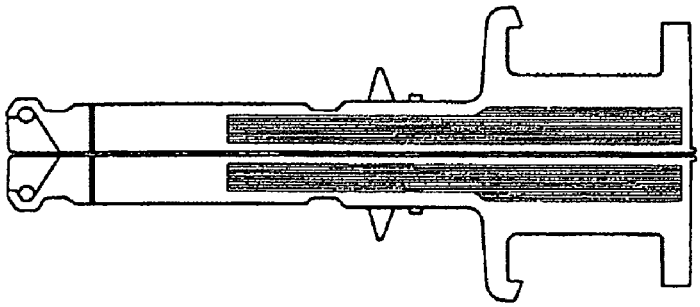
Figure 5A:
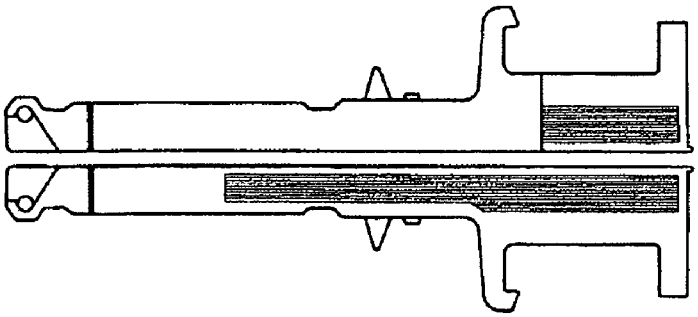

FIG. 5 is a planar drawing that shows the circumstances in which the keys are set in a jig in the case where printing is done. FIG. 5(*a*) shows the circumstances for the setting in a jig so that it is possible to do the printing of the left side of C8, the key of the highest pitch, and the right side of A0, the key of the lowest pitch, at the same time. In the same manner, FIG. 5(*b*) shows the circumstances for the setting in a jig so that it is possible to do the printing of the left side of the pitch notation C and the right side of the pitch notation E, or the left side of the pitch notation F and the right side of the pitch notation B, at the same time.

In the same manner, FIG. 5(*c*) shows the circumstances for the setting in a jig so that it is possible to do the printing of the left side of the pitch notation E and the right side of the pitch notation C, the left side of the pitch notation B and the right side of the pitch notation F, or the left side and the right side of any of the pitch notations G, A, and D, at the same time. The printing may also be carried out once by setting a plurality of these groups in a single jig.

Figure 6A:
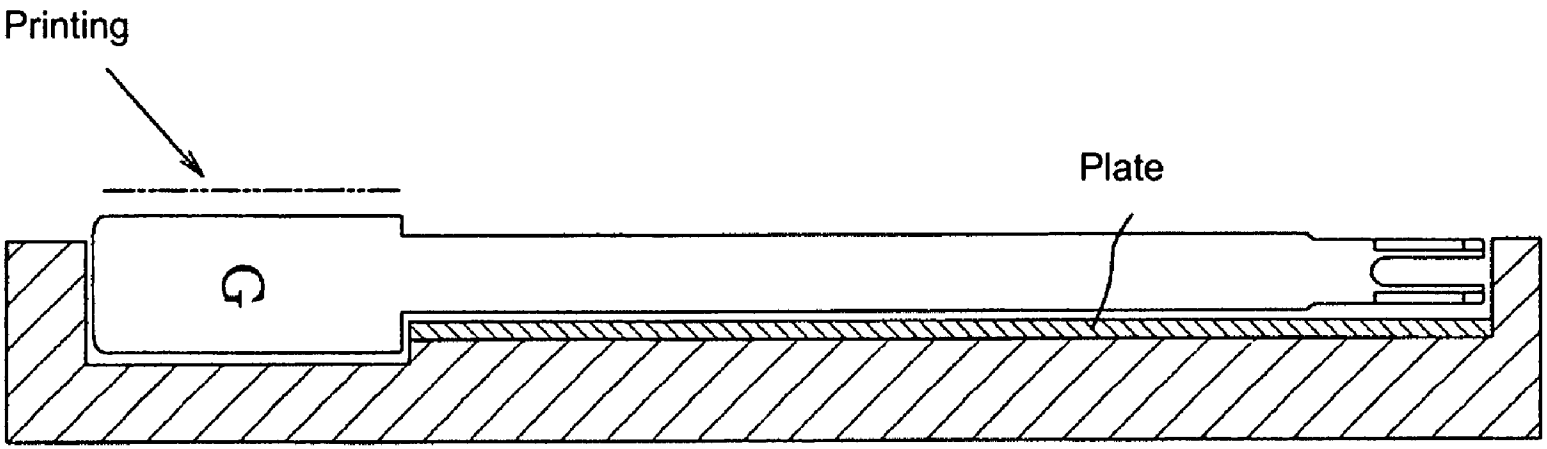
FIG. 6 is a cross-section drawing that shows the jig in which the white keys have been set.
Figure 6B:
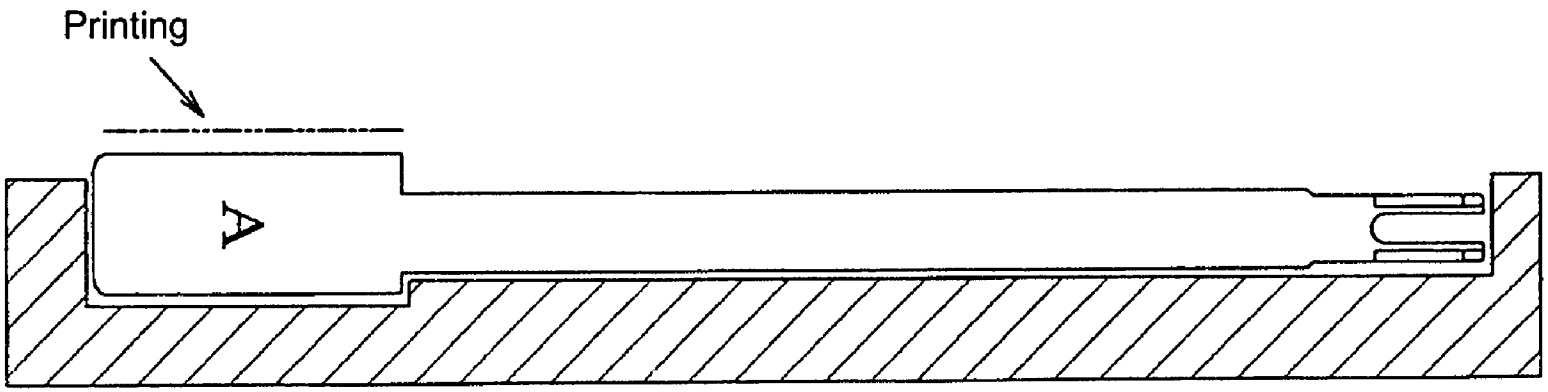

FIG. 6 is a cross-section drawing that shows the cross-section of a jig for carrying out this kind of printing. FIG. 6(*a*) shows the circumstances in which the white key of the pitch notation G is set in a jig. Since the height of the step of the area where the black key is arranged is different depending on the type of the white key, a plate is set in the area that comes in contact with the step and the white key is set. FIG. 6(*b*) shows the circumstances in which a white key of the pitch notation A is set in a jig and since the area of the step at which the black key is arranged is formed in the shape of the pitch notation A, a plate is not arranged.

As has been explained above, in this embodiment, since the printing of the wood grain pattern is done in a specified area of a portion that is separated by a uniform gap from the upper surface and front surface on the left and right side surfaces of the white keys, it is possible to produce a keyboard apparatus for which the appearance is good and that provides a feeling of high quality with a simple configuration. In addition, since in those cases where the printing is done, a plurality of keys are set in a jig in conformance with the type of the white keys 2, hence it is possible to carry out the printing on the side surfaces of a plurality of keys at the same time.

Next, an explanation will be given regarding the keyboard apparatus 1 of another preferred embodiment while referring to FIG. 7. Explanations for those portions with the same keys as those in the keyboard apparatus 1 of the previous embodiment described above will be omitted. An explanation will be given regarding the portions that are different.

Figure 7B:
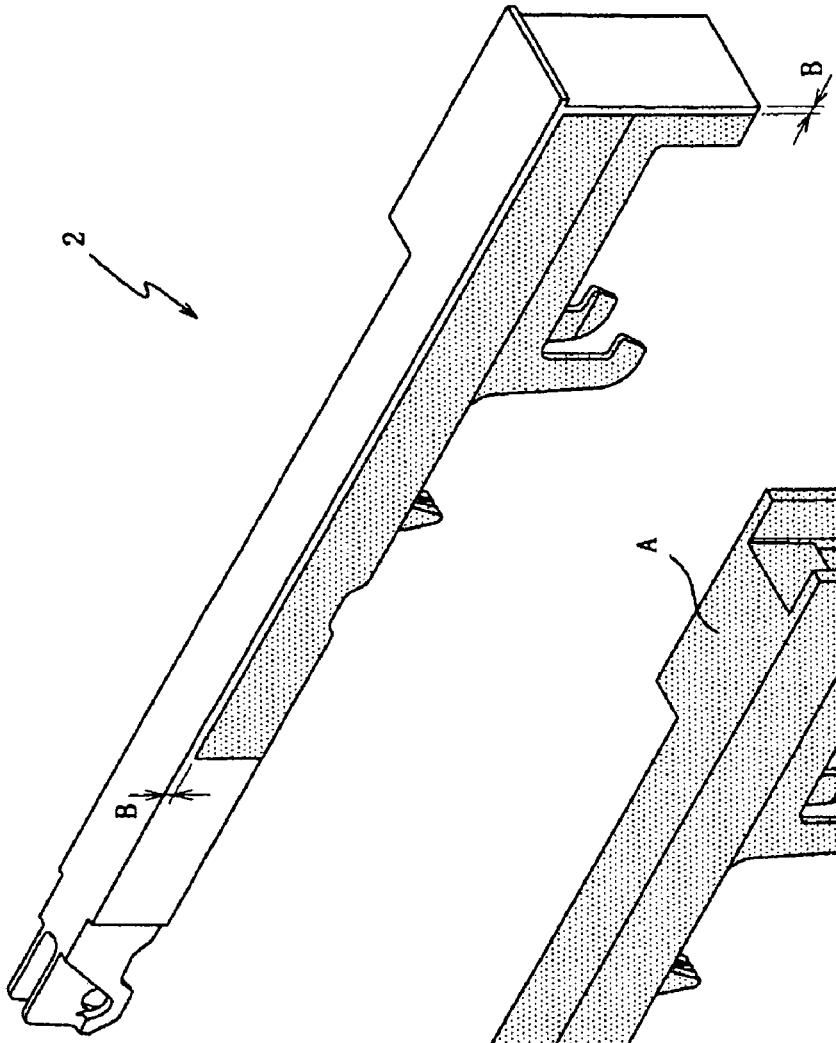
FIG. 7 is an oblique view drawing that shows the white key in another preferred embodiment using two types of resins.
Figure 7A:
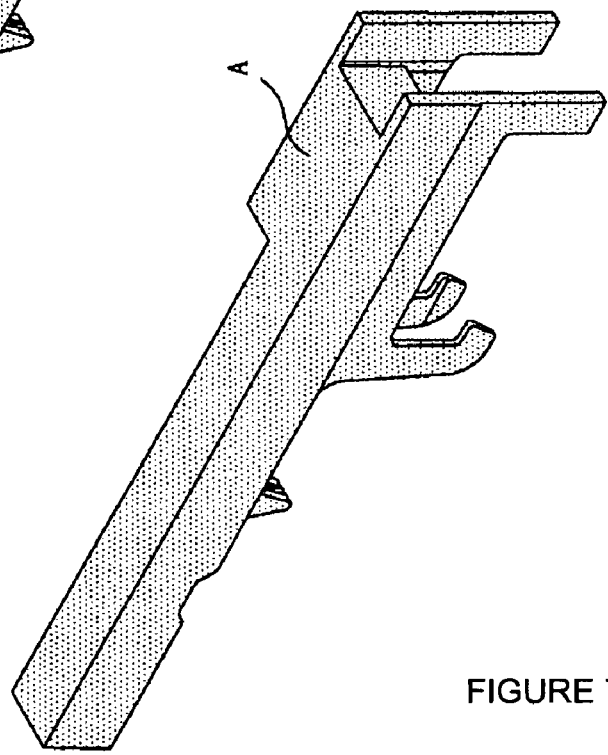

FIG. 7 shows the molding of the white keys 2 with two types of resin using the so-called double injection molding method. First, as shown in FIG. 7(*a*), a lower portion (the inside portion) A of the white key is molded with a resin the matches the color of the wood grain pattern. Then, as is shown in FIG. 7(*b*), two-layer molding of the outside portion is done with a white colored resin so that the molded item is covered.

The white colored resin is molded such that the thickness of the upper surface and the front surface of the white key 2 is a uniform width B. By this means, in those cases when an adjacent white key 2 has been pressed down, the side surface of the white key 2 is becomes visible and it appears as if the inside of the white key 2 is formed from wood with the white colored resin affixed to the upper surface and the front surface. Therefore, the appearance of the keys is satisfactory and there is a feeling of high quality. In addition, the upper surface and the front surface, which are the portions that are touched by a person's fingers and that are visible, are formed from high cost resin materials. However, the inner portion is formed with low cost resin materials, hence it is possible to form the white keys 2 at a low cost.

In the preferred embodiment shown in FIG. 7, the outside portion of the white key 2 is shown with the upper surface and front surface of the white key 2 as well as the swinging movement shaft hole formed integrated in single unit. However, it may be also be done so that only the upper surface portion and the front surface portion of the outside portion of the white key 2 are formed, and the swinging movement hole is formed on the inside portion of the white key 2.

Next, an explanation will be given regarding a preferred embodiment of the inner portion of the front end of the white key, which is common to both of the previous two preferred embodiments.

FIG. 8 is a cross-section drawing that shows the circumstances in which the hollow of the inner portion of the front end portion of the white key 2 that has been formed with resin is packed with a material such as an adhesive agent. In those cases where the front end portion of the white key 2 is formed with a resin, this becomes a flat surface with a comparatively large area and the lower portion of the key is formed hollow. There are instances in which, when the finger nails of the performer hit this area at the time that a performance is carried out, the hollow portion of the lower portion resonates and produces a comparatively large unpleasant sound. In order to prevent this, one could consider increasing the thickness of this portion. However, if the thickness is increased, sink marking occurs and it is difficult to mold in a regular shape. Therefore, measures such as the following could be taken.

FIG. 8(*a*) shows the situation in which the lower portion of the front end of the white key is packed with an adhesive agent that contains a material such as a resin as a constituent. The lower surface of the resin that has been packed is formed such that the resin is parallel with the horizontal plane of the surface of the white key. Incidentally, FIG. 8(*a*-1) is a planar drawing of the white key 2 viewed from the top, FIG. 8(*a*-2) is a lateral cross-section drawing, and FIG. 8(*a*-3) is a planar drawing of the white key 2 viewed from below.

FIG. 8(*b*) is a lateral cross-section drawing of the white key 2 and is one that has been packed in the same manner with an adhesive agent that contains a material such as a resin as a constituent. The lower surface of the resin that has been packed is formed such that the resin is inclined with respect to the horizontal plane of the surface of the white key.

FIG. 8(*c*) shows the circumstances in which a large number of lattice shaped demarcations have been disposed in the lower portion of the front end of the white keys and each of the lattice form compartments packed with an adhesive agent containing a material such as a resin as a constituent. By producing this kind of structure, it is possible to firmly pack and fix the adhesive agent. Incidentally, FIG. 8(*c*-1) is a lateral cross-section drawing of the white key 2 and FIG. 8(*c*-2) is a planar drawing of the white key 2 viewed from below.

In the same manner, FIG. 9 shows the circumstances in which wood is affixed to the lower portion of the front end of the white key. The bottom surface of the wood in this case is shaped so as to be parallel with the horizontal plane of the surface of the white key. FIG. 9(*a*-1) is a planar drawing of the white key 2 viewed from the top, FIG. 9(*a*-2) is a lateral cross-section drawing, and FIG. 9(*a*-3) is a planar drawing of the white key 2 viewed from below.

FIG. 9(*b*) shows the circumstances in which the bottom surface of the wood is formed in a peaked shape. FIG. 9(*b*-1) is a lateral cross-section drawing of the white key 2 and FIG. 9(*b*-2) is a planar drawing of the white key 2 viewed from below.

FIG. 9(*c*) shows the circumstances in which the lower portion of the front end of the white key has been packed with urethane foam. FIG. 9(*c*-1) is a lateral cross-section drawing of the white key 2 and FIG. 9(*c*-2) is a planar drawing of the white key 2 viewed from below.

FIG. 10(*a*) shows a white key that has been formed using insert molding such as the insertion of a resin with high specific gravity in the lower portion of the front end of the white key. FIG. 10(*a*-1) is a planar drawing of the white key 2, FIG. 10(*a*-2) is a lateral cross-section drawing, and FIG. 10(*a*-3) is a planar drawing of the white key 2 viewed from below.

FIG. 10(*b*) shows a white key that has been formed in the same manner using insert molding such as the insertion of a resin with high specific gravity in the lower portion of the front end of the white key. The resin on this occasion is molded with a wood grain pattern resin and then the portion that covers the upper portion and the front surface of the white key is molded with a white resin. By doing the molding in this way, the upper portion and the front surface of the white key are formed in a white color and the side surface of the white key is formed in a wood grain pattern.

FIG. 10(*b*-1) is a completed lateral drawing of the white key 2 and FIG. 10(*b*-2) is a lateral cross-section drawing that shows the aspect in which a portion of the lower portion of the white key 2 is molded using a wood grain pattern resin and, together with this, is insert molded such that a resin with a high specific gravity is inserted in the front end portion of the white key 2. FIG. 10(*b*-3) is a lateral cross-section drawing that shows the aspect in which a white colored resin has been molded on the upper surface and the front surface of the item shown in FIG. (b-2).

As has been explained based on the above preferred embodiments, in accordance with the keyboard apparatus of the present invention, since a gap having a uniform separation is left between the upper surface and the front surface on the side surface of the white key molded using a resin, and that the key has a grained portion with a wood grain portion in a specified area, when a key is pressed down, the side surface of the white key 2 is exposed and it is possible to give the appearance that the inner portion of the white key 2 is formed using wood. Accordingly, a keyboard apparatus that has a feeling of high quality can be provided at low cost.

In addition, because the lower portion of the front end of the white key 2 is packed with an adhesive agent that has a resin as a constituent, when the key is hit by a fingernail of the performer during a performance, it possible to prevent the production of an unpleasant sound.

An explanation was given above regarding the present invention based on preferred embodiments but the present invention is not in any way limited to the preferred embodiments that have been discussed above and the possibility of various modifications and changes that do not diverge from and are within the scope of the tenor and purport of the present invention can be easily surmised.

For example, in the preferred embodiments described above, an explanation was given regarding the configuration of the white keys 2 of a keyboard apparatus 1 that is employed in an electronic musical instrument. However, this white key 2 may also be used in the keyboard apparatus of a so-called acoustic keyboard instrument.

In one of the preferred embodiments described above, two-layer molding of the keys was done using a double injection molding method. However, it may also be done such that the outside portion and the inside portion are each molded as individual members and these are bonded or fused together.

In addition, the preferred embodiments describe specific materials used to pack the hollow of the inner portion of the front end portion of the white keys. Other materials which can accomplish the same function of preventing an unpleasant sound during the performance when a performer's fingernail hits the keys can also be used.

What is claimed is:

1. A keyboard apparatus comprising white keys, wherein the white keys comprise:

a white colored resin on side surfaces of the white keys, a specified gap left between the a top surface and a front surface, and a grained portion colored in a wood grain pattern having a specified area;

wherein a lower surface of a front end portion of the white keys is packed with an adhesive agent that has a resin as a constituent.

2. The keyboard apparatus according to claim 1, wherein the grained portion is formed by printing the wood grain pattern onto the white colored resin of the white keys.

3. The keyboard apparatus cited in claim 1, wherein the grained portion is formed from a wood grain patterned resin different from the white colored resin.

4. A keyboard apparatus comprising white keys formed using a double injection molding method, wherein said white keys comprises:

an outside portion forming a top surface and a side surface of the white keys comprising a white colored resin material, and an inside portion comprising a wood grain pattern resin, wherein the inside portion is positioned below the outside portion and forms a second side surface of the key;

wherein a lower surface of a front end portion of the white keys is packed with an adhesive agent that has a resin as a constituent.

5. The keyboard apparatus according to claim 4, wherein:

the top surface of the outside portion covers the top of the inside portion, the side surface joins the upper surface on a left, a right and a front edge, and, wherein the top surface and the side surface are formed from a plate having a roughly uniform thickness.

6. The keyboard apparatus according to claims 1, wherein a resin that is different from the resin that forms the white keys is inserted in a front end portion of the white keys using insert molding.

7. The keyboard apparatus according to claims 4, wherein a resin that is different from the resin that forms the white keys is inserted in a front end portion of the white keys using insert molding.

8. A keyboard apparatus comprising a white key, wherein a lower cavity of a front end portion of the white key is filled with a filling material different than materials used to form a top, front, or side surface of the white key, wherein the filling material is an adhesive agent packed into the lower cavity, wherein the adhesive material has a resin as a constituent.

9. The keyboard apparatus according to claim 8, wherein the filling material is a resin inserted into the lower cavity using insert molding.

10. A method of manufacturing a white key for a keyboard apparatus, comprising the steps of:

forming a top surface of the white key with a white color, forming a side surface of the white key such that a portion of the side surface has wood grained pattern and a second portion of the side surface adjoining the top surface has the white color;and filling a lower cavity of a front end portion of the white key with a filling material different than materials used to form the top surface or the side surface of the white key.

11. The method of manufacturing a white key for a keyboard apparatus according to claim 10, further comprising the step of forming the portion with the wood grained pattern differently for keys corresponding to different pitch notes such that when one white key is pressed down, the portion with the wood grain pattern of a neighboring white key is exposed.

12. The method of manufacturing a white key for a keyboard apparatus according to claim 10, further comprising the steps of:

forming the top surface and side surface of the white key using a white resin material, and printing a wood grained pattern onto the portion of the side surface.

13. The method of manufacturing a white key for a keyboard apparatus according to claim 10, further comprising the steps of:

forming the top surface of the white key using a white resin material, and forming the side surface of the white key using a wood grain patterned resin material.

* * * * *